US005397134A

United States Patent [19]

Fishman et al.

[11] Patent Number: 5,397,134

[45] Date of Patent: Mar. 14, 1995

[54] WINNER EVERY TIME CRANE GAME APPARATUS AND METHOD

[75] Inventors: Stan D. Fishman, Hillsboro Beach; David Hodge, Boca Raton, both of Fla.

[73] Assignee: Advanced Games & Engineering, Inc., Fort Lauderdale, Fla.

[21] Appl. No.: 154,261

[22] Filed: Nov. 18, 1993

[51] Int. Cl.[6] ..... A63F 9/00; G07F 17/32

[52] U.S. Cl. ..... 273/448; 221/210; 273/138 A

[58] Field of Search ..... 273/447, 448, 440, 138 R, 273/138 A; 221/210

[56] References Cited

U.S. PATENT DOCUMENTS 4,718,667 1/1988 Shoemaker ..... 273/448

5,067,712 11/1991 Georgilas ..... 273/143 R

*Primary Examiner*—Benjamin H. Layno

*Attorney, Agent, or Firm*—Oltman and Flynn

[57] ABSTRACT

A prize dispensing game includes a prize retaining housing, a prize dispensing port, a prize dispensing assembly, a play credit registering assembly, a prize dispensing sensor adjacent to the prize dispensing port, and a credit deactivating assembly controlled by the prize dispensing sensor. The retaining housing preferably includes a prize retaining box with a box wall having a prize viewing window. The prize dispensing port preferably includes a passageway having a passageway side wall. The prize dispensing sensor preferably includes an electronic eye in said side wall generating a sensing beam across the passageway. The dispensing sensor preferably additionally includes a circuit for carrying an electronic signal generated by the electronic eye and a signal filtering circuit. The signal filtering circuit preferably includes a circuit for inverting the signal and a resistor. The credit deactivating assembly preferably includes a decade counter integrated circuit for receiving the electronic signal and removing play credit when the signal fluctuates. A method of playing the prize dispensing game includes the steps of registering play credit by inserting a coin into the play credit coin registering assembly, and operating the prize dispensing assembly with a control to place one prize into the prize dispensing port, thereby deactivating the play credit and disabling the game with the credit deactivating assembly.

8 Claims, 3 Drawing Sheets

WINNER EVERY TIME CRANE GAME APPARATUS AND METHOD

BACKGROUND OF THE INVENTION

1. Field of the Invention

The present invention relates generally to the field of semi-automated games, and more specifically to a crane game apparatus which is preferably coin operated and which permits continued play on the same play credit until a prize is dispensed, the game apparatus preferably including a retaining housing for retaining a plurality of prizes and having a prize dispensing passageway, a conventional crane structure within the housing having remote operating control for a game player to grip a prize and drop the prize into the dispensing passageway, a coin receiving assembly for receiving a coin to register a play credit and enable the crane structure, an inventive sensing assembly for detecting the passage of a prize through the passageway, removing the play credit and disabling the crane structure until another play credit is registered by depositing another coin in the coin receiving assembly, so that winning is effectively guaranteed because play credit is not lost until a prize item is dispensed, the sensing assembly preferably including an electric eye located in the passageway to detect the passage of a prize item, two integrated circuit chips which operate together to signal the removal of play credit once the prize has passed through the beam of the electric eye.

2. Description of the Prior Art

There have long been semi-automated games which dispense prize items such as candy and stuffed animals when a certain task is successfully performed. An example is the crane game machine often seen in shopping malls and game rooms where a number of prize items are contained within a transparent housing. A crane mechanism above the prize items is operated from outside the housing with a joy stick or equivalent control to attempt to grasp and carry a prize item to a dispensing chute. The game is typically activated by inserting a coin in a receiving slot and deactivated either by the passage of a predetermined time limit or by a pre-set number of prize grasping attempts.

A problem with this type of game is that children can become frustrated and discouraged with the game when they do not win. Many adults would quickly loose interest as well, having lost several coins with no tangible return on their money. Another problem is that a highly skilled player might receive numerous prizes and play repeatedly, to the financial detriment of the game owner.

The only alternative has been to provide dispensing machines which simply dispense a prize item when a coin is inserted and a control activated. An example is the familiar gum ball machine. A problem with a simple dispensing machine is that no entertainment is provided. One is effectively paying an automated cashier for a purchase rather than playing a game.

It is thus an object of the present invention to provide a prize item dispensing game apparatus which virtually assures that the player will be rewarded with a prize before the game is concluded.

It is another object of the present invention to provide such a game apparatus which will only dispense one prize or one set of prizes for a single play credit.

It is still another object of the present invention to provide such a game apparatus which is relatively simple and reliable in construction.

It is finally an object of the present invention to provide such a game apparatus which is relatively inexpensive to manufacture.

SUMMARY OF THE INVENTION

The present invention accomplishes the above-stated objectives, as well as others, as may be determined by a fair reading and interpretation of the entire specification.

A prize dispensing game is provided, including a prize retaining housing, a prize dispensing port, a prize dispensing assembly, a play credit registering assembly, a prize dispensing sensor adjacent to the prize dispensing port, and a credit deactivating assembly controlled by the prize dispensing sensor. The retaining housing preferably includes a prize retaining box with a box wall having a prize viewing window. The prize dispensing port preferably includes a passageway having a passageway side wall. The prize dispensing sensor preferably includes an electronic eye in said side wall generating a sensing beam across the passageway. The dispensing sensor preferably additionally includes a circuit for carrying an electronic signal generated by the electronic eye and a signal filtering circuit. The signal filtering circuit preferably includes a circuit for inverting the signal and a resistor. The credit deactivating assembly preferably includes a decade counter integrated circuit for receiving the electronic signal and removing play credit when the signal fluctuates.

A method is also provided of playing a prize dispensing game including the steps of registering play credit by inserting a coin into the play credit coin registering assembly, and operating the prize dispensing assembly with a control to place one prize into the prize dispensing port, thereby deactivating the play credit and disabling the game with the credit deactivating assembly.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
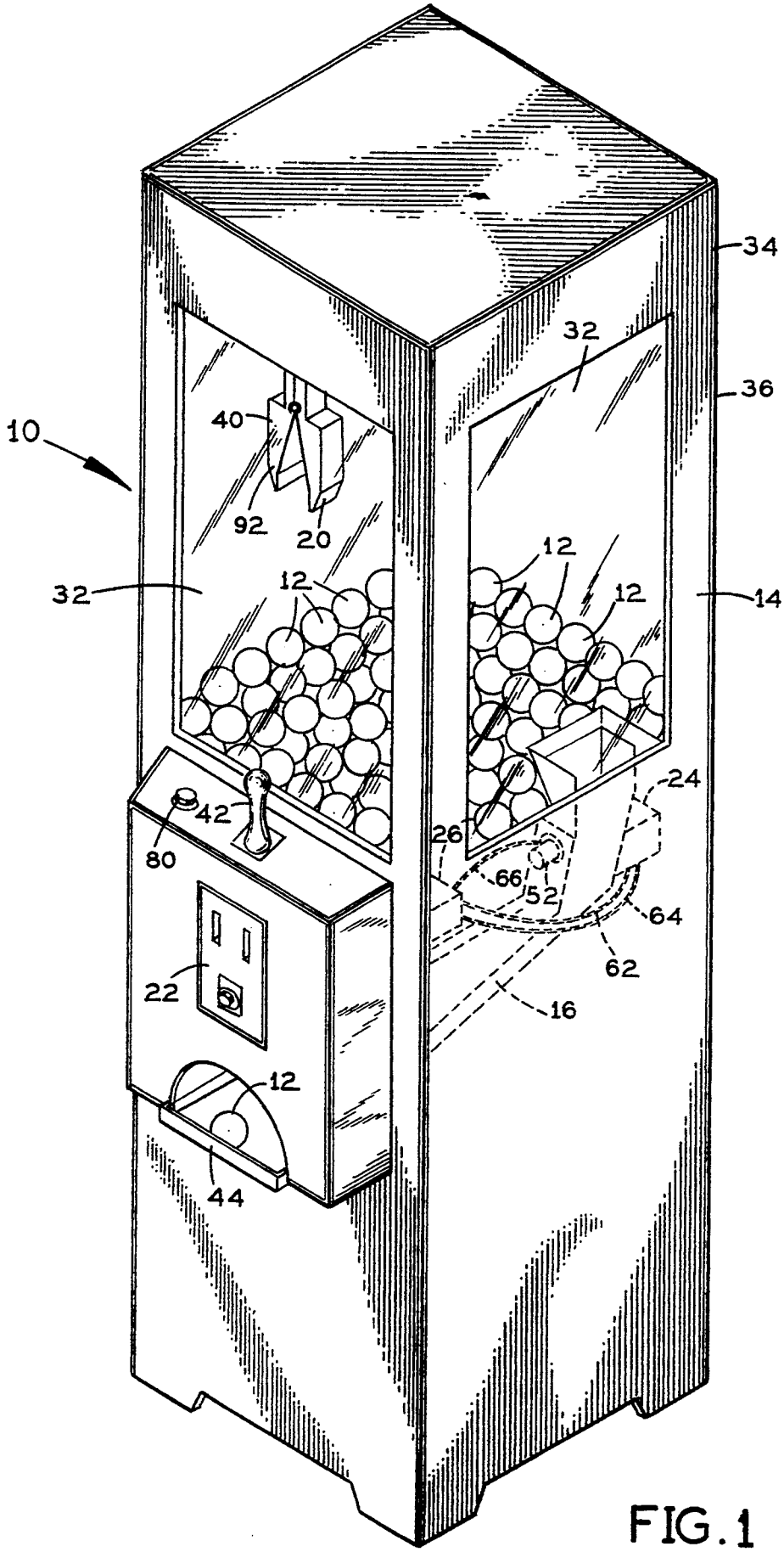
FIG. 1 is a perspective view of the preferred embodiment of the inventive game apparatus. Broken lines indicate the internal passageway and prize sensing elements.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 2:
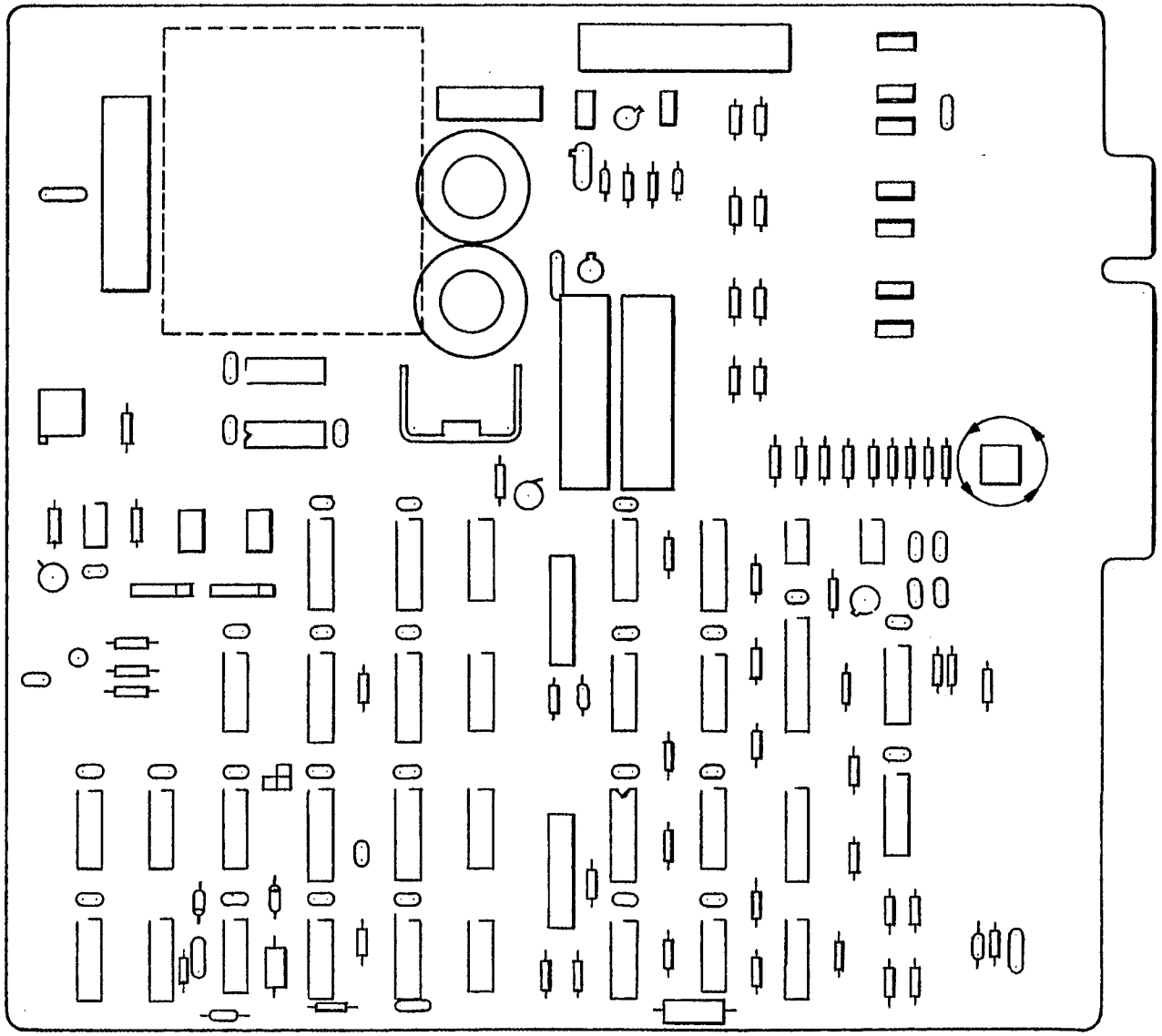
FIG. 2 is a schematic view of the game apparatus circuitry showing actual circuit elements.
Figure 3:
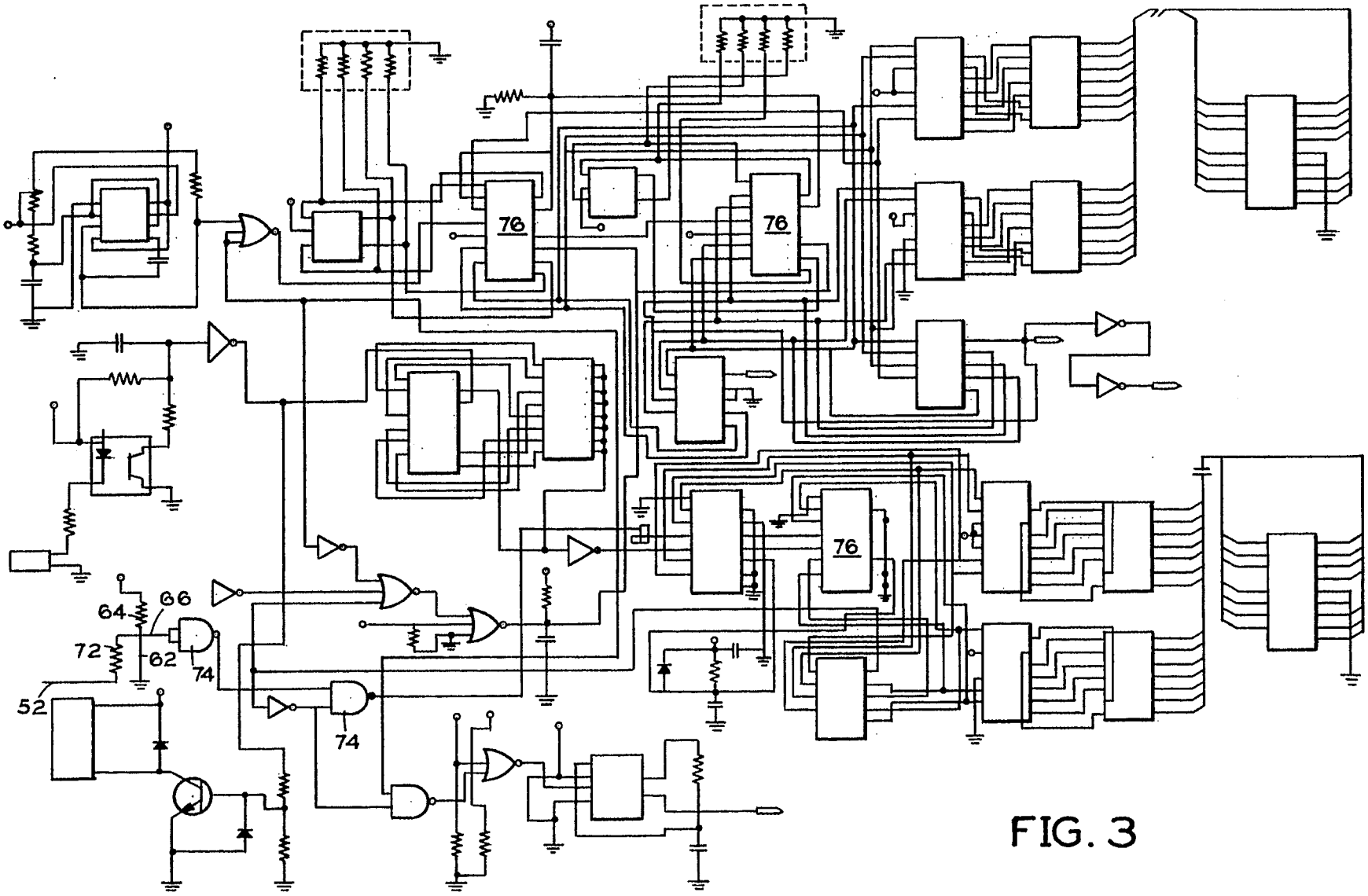
FIG. 3 is a schematic wiring diagram showing the preferred game apparatus circuitry.

Referring to FIGS. 1–3, a prize dispensing game apparatus 10 is disclosed which is preferably coin operated and which permits continued play on the same play credit until a prize 12 is dispensed. The essential elements of apparatus 10 are a prize retaining housing 14, a prize dispensing passageway 16, a prize dispensing assembly 20, a play credit registering assembly 22, a prize dispensing sensing assembly 24 and a play credit deactivating assembly 26. This inventive and synergistic combination of elements may be constructed from any of numerous individual game structures known in the art. The preferred elements include inventive structures as set forth below.

Retaining housing 14 is preferably a box sized to hold several dozen or more prizes 12, such as candy, gum, stuffed animals, toys or other desirable items. Housing 14 preferably has either glass or plexiglass windows 32 in its walls 34 so that the player can see the prizes 12, form a desire to possess one, and manipulate the game apparatus 10 to secure one. Housing 14 has a lockable door 36 through which the game owner inserts prizes 12 as necessary to keep apparatus 10 usable. Housing 14 also includes a prize dispensing passageway 16 through which a prize 12 may be dispensed to a player upon "winning" the game. Prize dispensing assembly 20 preferably includes a conventional game crane structure 40 within housing 14, having a remote operating control 42 outside housing 14, such as a joy stick. The player operates crane structure 40 with control 42 to grasp a prize 12 and lift the prize 12 over the entrance to passageway 16. Then the player releases prize 12 so that it drops into passageway 16 and slides to a dispensing opening 44 accessible to the player.

A key inventive feature of this embodiment of apparatus 10 is a the inclusion of a prize 12 sensing assembly 24 in passageway 16 for detecting the passage of a prize 12 through passageway 16. Upon sensing the passage of a prize through passageway 16 the play credit is removed and the game disabled. Thus the duration of play and the number of prize 12 securing attempts always equal the number it takes an individual player on a given occasion to win. The enjoyment of playing as well as the enjoyment of winning are always assured, making for happy and satisfied customers who may be encouraged to play again. On the other hand, the game owner never looses money because skilled players return to take many prizes 12 for each coin inserted.

The prize 12 sensing, credit removing and game disabling assemblies are preferably constructed as follows. Specific voltages, resistances, and integrated circuits recited below are merely exemplary and should not be construed as limiting. The dispensing sensing assembly 24 includes an electric eye 52 mounted in a passageway 16 wall, and operating as a switch and connected to three wires for control. See FIG. 3. First wire 62 is a −12 volt DC connection which remains in the "on" mode. Second wire 64 is a +12 volt DC connection which also remains constant and in the "on" mode. Third wire 66 is a signal connection which remains at a constant high voltage level until electric eye 52 is blocked as a prize 12 passes. The passing of a prize 12 beside electric eye 52 interrupts the eye beam and causes the signal voltage of +12 volts DC to drop momentarily. Then the signal voltage returns to the original high level after a prize 12 has passed out of the eye 52 beam.

The signal coming from electric eye 52 continues through a resistor 72, preferably of 1000 ohms, and then into an integrated circuit 74, preferably a 4093 HEX SCHMIDT TM Trigger. As the signal is normally high, such as +12 volts DC until interrupted by a prize 12 passing through the eye 52 beam, and going low to approximately zero volts DC, it creates a square wave. See FIG. 1. This square wave needs to be filtered electronically to remove any excess noise or static generated during the switching mode. This filtering is a two step process including feeding the signal through an invertor twice, effectively changing the signal's polarization from "high-on" to "low-on", and then back again. This is done, again, by using 4093 HEX SCHMIDT TM Trigger 74 as the inverting integrated circuit chip.

From the eye 52, passing through a resistor 72, then through an invertor integrated circuit 74 twice, the signal is cleaned and filtered, and ready to enter a final stage where it electronically signals the removal of the play credit stored within a 74C192 Decade (10) up/-down counter 76. Since the voltage from electric eye 52 is maintained normally at +12 volts DC (positive twelve volts −DC), and is interrupted with the passing of a prize 12 across the eye 52 beam, the signal drops to a near zero voltage (0 volts DC) momentarily and then returns to the high (+12 volts DC) voltage.

With the signal voltage drop, the 74C192 decade counter senses this low pulse at the connection for down count at its data input line, which is pin #4 of the 74C192 integrated circuit 76. This low pulse removes any play credit remaining in storage within the 74C192 integrated circuit 76, thus sending a zero credit signal to a display box 80. If no prize 12 breaks the eye 52 beam, then no credits are removed. The credit displays remain, and the player can continue to play game apparatus 10 until they win a prize 12. Once credit is removed, the game play mode is disabled.

Method

In practicing the invention, the following method may be used. The player inserts a coin into a play credit registering assembly 24 in apparatus 10. A play credit is registered and apparatus 10 resets to a ready/run mode. The player operates control 42 such as a joy stick to signal the start of a game. A timer display begins a countdown sequence. The player controls crane structure 40 movements with control 42. The player rests a crane carriage over a desired prize 12 and presses a drop claw control button. A crane claw 92 drops down to abut the desired prize 12, resting on prize 12. The timing sequence ends, signalling claw 92 to close around the desired prize 12, and then retract, lifting the prize 12 and carrying prize 12 to a position over the entrance to passageway 16. The claw 92 opens and thereby permits the prize 12 to fall into and slide through passageway 16, breaking the eye 52 beam. The signal is sent within apparatus 10 as discussed above to remove play credit and disable the game. The game returns to an attraction mode, displaying zero "00" credits in display box 80.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A prize dispensing game, comprising:

a prize retaining housing, a prize dispensing port, prize dispensing means, play credit registering means, a prize dispensing sensor adjacent said prize dispensing port, and credit deactivating means controlled by said prize dispensing sensor.

2. An apparatus according to claim 1, wherein said retaining housing comprises a prize retaining box with a box wall having prize viewing window means.

3. An apparatus according to claim 1, wherein said prize dispensing port comprises a passageway having a passageway side wall.

4. A method of playing a prize dispensing game comprising a prize retaining housing, a prize dispensing port, prize dispensing means, play credit registering means, a prize dispensing sensor adjacent said prize dispensing port, and credit deactivating means controlled by said prize dispensing sensor, comprising the steps of:

registering play credit by inserting a coin into said play credit registering assembly, operating said prize dispensing means with control means to place one said prize into said prize dispensing port, thereby deactivating said play credit and disabling said game with said credit deactivating means.

5. A prize dispensing game, comprising:

a prize retaining housing, a prize dispensing port, prize dispensing means, play credit registering means, a prize dispensing sensor adjacent said prize dispensing port, credit deactivating means controlled by said prize dispensing sensor, wherein said prize dispensing port comprises a passageway having a passageway side wall, wherein said prize dispensing sensor comprises an electronic eye in said passageway side wall, generating a sensing beam across said passageway.

6. An apparatus according to claim 5, wherein said prize dispensing sensor additionally comprises:

a circuit for carrying an electronic signal generated by said electronic eye and signal filtering means.

7. An apparatus according to claim 6, wherein said filtering means comprises a circuit for inverting said signal and a resistor.

8. An apparatus according to claim 7, wherein said credit deactivating means comprises decade counter integrated circuit for receiving said electronic signal and removing play credit when said signal fluctuates.

* * * * *